US009295283B2

(12) United States Patent
Prevost

(10) Patent No.: US 9,295,283 B2
(45) Date of Patent: Mar. 29, 2016

(54) CIGARETTE ROLLING AND FORMING DEVICES

(71) Applicant: David Prevost, Portland, OR (US)

(72) Inventor: David Prevost, Portland, OR (US)

( * ) Notice: Subject to any disclaimer, the term of this patent is extended or adjusted under 35 U.S.C. 154(b) by 630 days.

(21) Appl. No.: 13/692,875

(22) Filed: Dec. 3, 2012

(65) Prior Publication Data

US 2013/0092181 A1 Apr. 18, 2013

Related U.S. Application Data

(63) Continuation-in-part of application No. 12/136,650, filed on Jun. 10, 2008, now Pat. No. 8,322,349.

(51) Int. Cl.

| | |
|---|---|
| ***A24C 5/00*** | (2006.01) |
| ***A24C 5/18*** | (2006.01) |
| ***A24C 5/40*** | (2006.01) |
| ***A24C 5/44*** | (2006.01) |

(52) U.S. Cl.
CPC ... *A24C 5/18* (2013.01); *A24C 5/40* (2013.01); *A24C 5/44* (2013.01)

(58) Field of Classification Search
None
See application file for complete search history.

(56) References Cited

U.S. PATENT DOCUMENTS

| | | | | |
|---|---|---|---|---|
| 338,580 A | | 3/1886 | Arnold | |
| 1,087,230 A | | 2/1914 | Garwood | |
| 1,909,749 A | | 5/1933 | Booth | |
| 1,956,838 A | | 5/1934 | Steuart | |
| 2,009,000 A | | 7/1935 | Zint | |
| 2,276,719 A | | 3/1942 | Daudelin | |
| D142,559 S | | 10/1945 | Herzog | |
| 2,436,015 A | | 2/1948 | Morris | |
| 2,471,656 A | | 5/1949 | Sas | |
| 3,746,011 A | * | 7/1973 | Kappeler et al. | 131/70 |
| 3,783,882 A | * | 1/1974 | Messner et al. | 131/70 |
| 3,903,902 A | * | 9/1975 | Messner et al. | 131/70 |
| 3,911,933 A | | 10/1975 | Crisp et al. | |
| 4,368,741 A | | 1/1983 | Meinunger | |

(Continued)

FOREIGN PATENT DOCUMENTS

| | | |
|---|---|---|
| DE | 29 43 136 A1 | 5/1981 |
| GB | 385870 A | 1/1933 |

(Continued)

OTHER PUBLICATIONS

Photos of prior art cigarette rolling device 1 (A-D).

(Continued)

*Primary Examiner* — Michael J Felton
(74) *Attorney, Agent, or Firm* — Schwabe, Williamson & Wyatt, P.C.

(57) ABSTRACT

Embodiments provide cigarette rolling and forming devices that include parallel cylinders extending between a pair of support plates, and a looped belt trained therearound. One cylinder is moveable relative to the other via a pair of curvilinear slots, and the device is configured for alternately receiving and compressing loose tobacco into a tobacco rod with the belt. In some devices, a nozzle is provided to allow longitudinal displacement of the formed tobacco rod into a pre-formed cigarette tube, and some devices include a pushing device to effect this longitudinal displacement. Some devices include a support trough disposed to prevent sections of the belt from contacting each other, and some devices include a clamping device configured to clamp a pre-formed cigarette tube on the nozzle to prevent its dislodging during use.

20 Claims, 7 Drawing Sheets

(56) References Cited

U.S. PATENT DOCUMENTS

| | | | | |
|---|---|---|---|---|
| 4,657,030 | A | | 4/1987 | Werding |
| 5,615,692 | A | * | 4/1997 | Ruppert et al. ..... 131/70 |
| D400,300 | S | | 10/1998 | Brandenburg et al. |
| D473,338 | S | | 4/2003 | Brandenburg et al. |
| D545,494 | S | | 6/2007 | Soeprapto |
| 2009/0301501 | A1 | | 12/2009 | Prevost |

FOREIGN PATENT DOCUMENTS

| | | | |
|---|---|---|---|
| GB | 438583 | A | 11/1935 |
| GB | 466 895 | A | 6/1937 |
| GB | 466895 | A | 6/1937 |
| WO | 2008059201 | A1 | 5/2008 |

OTHER PUBLICATIONS

Photos of prior art cigarette rolling device 2 (A-B).
Photos of prior art cigarette rolling device 3 (A-C).
Photos of prior art cigarette rolling device 4 (A-D).
Photos of prior art cigarette rolling device 5 (A-B).
Photos of prior art cigarette rolling device 6 (A-B).
Photos of prior art cigarette rolling device 7 (A-D).
Photos of prior art cigarette rolling device 8 (A-B).
Photos of prior art cigarette rolling device 9 (A-E).
Photos of prior art cigarette rolling device 10 (A-C).
Photos of prior art cigarette rolling device 11 (A-E).
Photos of prior art cigarette rolling device 12 (A-E).

* cited by examiner

Fig. 3
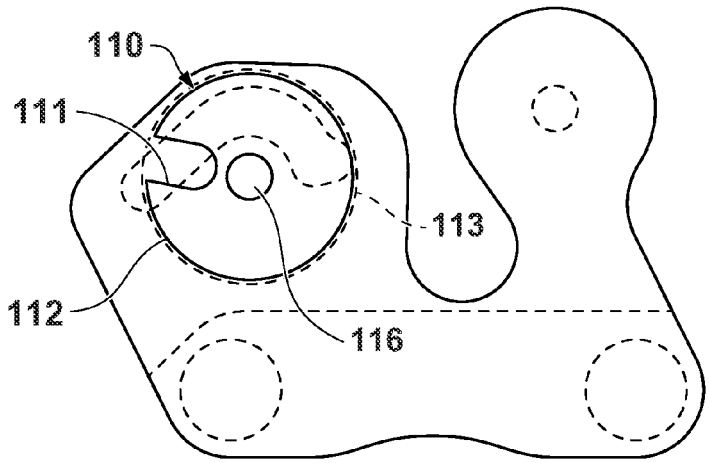
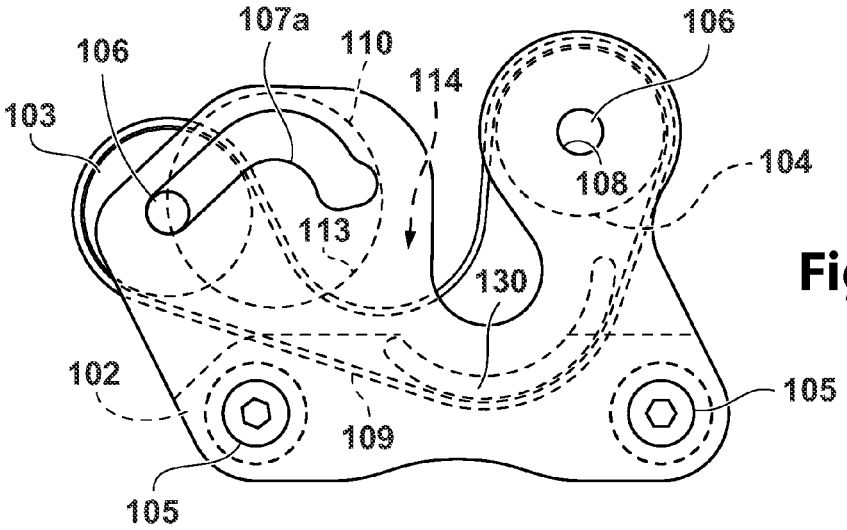
Fig. 4
Fig. 5
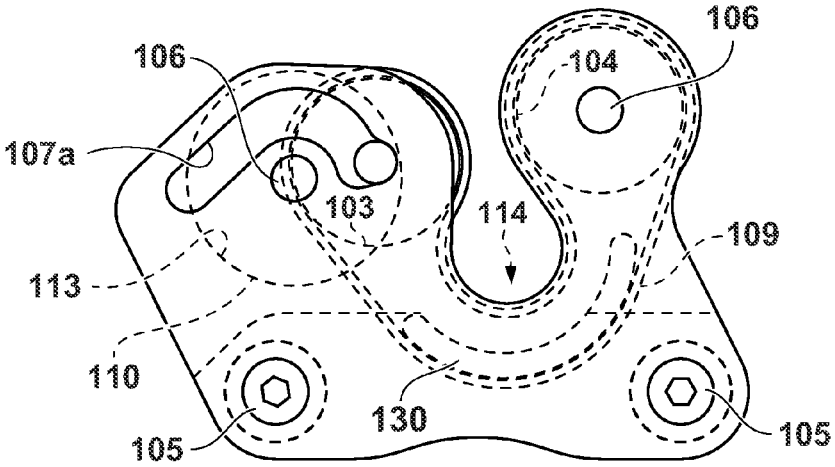

CIGARETTE ROLLING AND FORMING DEVICES

CROSS REFERENCE TO RELATED APPLICATIONS

The present application is a Continuation-in-Part of and claims priority to U.S. patent application Ser. No. 12/136,650, filed Jun. 10, 2008, entitled "CIGARETTE ROLLING AND FORMING DEVICES," the disclosure of which is hereby incorporated by reference in its entirety.

TECHNICAL FIELD

This disclosure relates generally to devices for making rolled cigarettes, and more particularly to hand-operated devices for making rolled cigarettes one at a time.

BACKGROUND

Some cigarette smokers prefer the process of making their own cigarettes to buying pre-rolled and pre-packaged cigarettes. For example, the individual components of a cigarette, such as tobacco and cigarette papers, when purchased in bulk, are often less expensive per cigarette than pre-made cigarettes. In addition, some people find enjoyment in making their own cigarettes, and may even consider cigarette-rolling to be a challenging endeavor in which to demonstrate skill.

One way to make cigarettes individually and manually is to place an amount of loose tobacco in a cigarette paper and roll it between one's fingers. However, this approach is limited in that it is somewhat difficult to produce a cigarette of uniform shape and fill, and outside influences (for example, bad weather in an outdoor setting, or jostling from other people in a crowded area) may increase the difficulty. Relatively small and simple devices that allow a user to make cigarettes are available; however, such devices small enough to fit comfortably in one's hand or on a table may not be capable of rolling consistently a high-quality cigarette. Other devices, though capable of improved function, may be too large to be carried easily in a pocket or handbag, if they may be carried at all.

Rolling devices conventionally include a framework in which two roughly parallel rollers are closely arranged, and in which a looped belt is configured to encompass the rollers, with enough slack to form a groove or recess between the rollers in which loose tobacco may be formed into a cylindrical shape. Usually, at least one of the rollers is movable between two positions: an "open" configuration in which the rollers have their greatest separation, so that a broad, shallow recess in the belt between the rollers is formed, into which loose tobacco may be placed, and a "closed" configuration in which the rollers have their least separation, so that the belt forms a narrower and deeper recess, in which the loose tobacco may be compressed or shaped by movement of the belt over the rollers. In such devices, a piece of cigarette paper may then be fed between the rollers and rolled around the compressed tobacco to form a finished cigarette.

Different constructions are used to enable movement of the rollers relative to each other. In some devices, the ends of the movable roller may be journaled in a slot that defines a range of movement of the roller (relative to the other roller), as the ends are slid along the slot. In some devices, the moveable roller is mounted on a pair of hinged arms that may swing the moveable roller away from, or toward, the other roller. Some devices may include two pairs of arms on a central hinge, so that the rollers may be moved away from, or toward, each other by opening and closing the hinge. Such devices, however, are prone to a number of difficulties in use, such as in manipulating the looped belt to form a cylinder of tobacco having a cigarette paper around it, rolling the rollers or otherwise smoothly moving the belt over the rollers to compress the tobacco, accumulating tobacco debris within the slots or openings holding the ends of the rollers, and binding of the looped belt as it passes through the device, and so forth. Each of these difficulties may result in a substandard manually-rolled cigarette, user frustration, mechanical failure, and so forth.

Also, such devices typically do not provide a mechanism by which a compressed cylinder of tobacco may be inserted into a pre-formed cigarette tube, for example if a user would prefer to use a pre-formed cigarette tube instead of a leaf of cigarette paper. Pre-formed tubes are commercially available, some of which include filter tips, which may be difficult to incorporate into a cigarette rolling device. Instead, different types of injector machines are available, which operate by compressing loose tobacco in a chamber, and then forcing the compressed tobacco into a pre-formed tube. Such machines are generally too large and/or mechanically complex to allow portability.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

FIG. 3 is an elevation view of a guard plate of the device of FIG. 1, shown in relation to the support plate of FIG. 2;

FIG. 4 is a side elevation view of the proximal end of the device of FIG. 1, with the device in an open configuration;

FIG. 5 is a side elevation view of the proximal end of the device of FIG. 1, with the device in a closed configuration;

DETAILED DESCRIPTION OF DISCLOSED EMBODIMENTS

Figure 1:
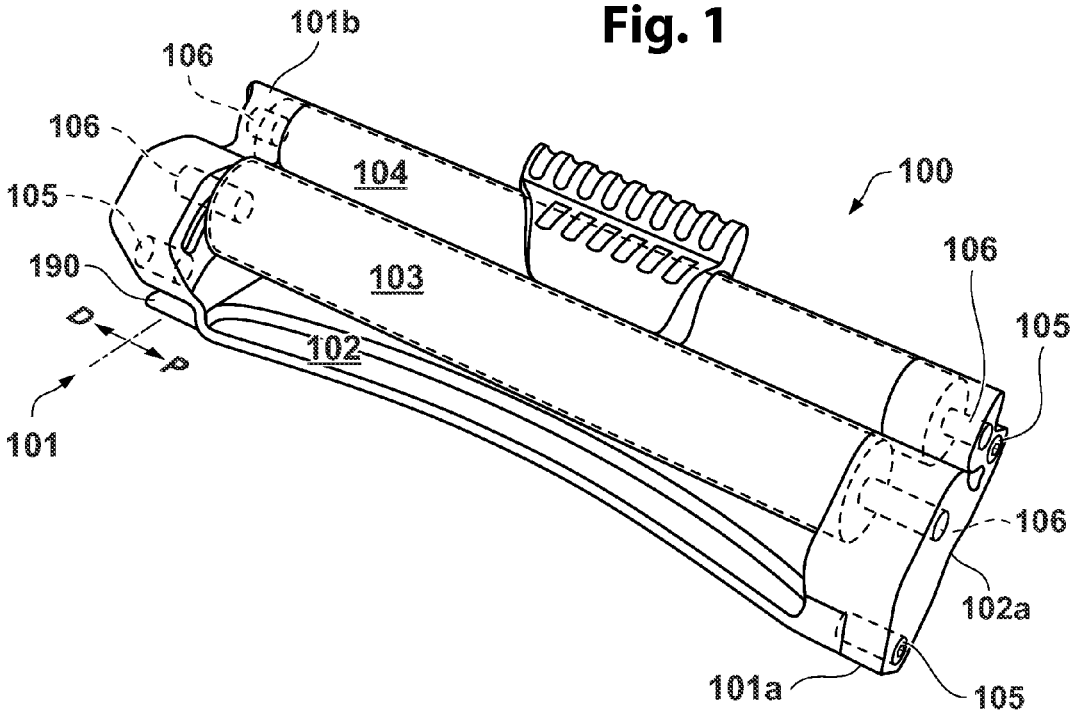
FIG. 1 is a top perspective view of an embodiment of a cigarette rolling device.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Disclosed herein are several embodiments of cigarette rolling and forming devices, which generally include two (or more) cylinders and a looped belt trained thereon, and which are configured to selectively compress a quantity of loose tobacco into a shaped tobacco cylinder. Some embodiments of cigarette rolling devices according to the present disclosure include one or more features that minimize or prevent mechanical clogging due to loose tobacco. For example, in some embodiments, a pair of opposing support plates extends from a base, with two cylinders extending between the support plates and rotatably mounted thereto. The support plates include a pair of corresponding slots, with axle portions of one of the cylinders being journaled therein for slidable movement, such the cylinder is translatably moveable relative to the support plates through a range of motion defined by the slots. In various embodiments, the base may have a curved, contoured, or generally "hourglass" shape, which may provide clearance for a user's fingers when opening and closing the device, forming the tobacco rod, and/or inserting the tobacco rod into a pre-formed cigarette tube. In some embodiments, the contoured or hourglass shape of the base also may reduce the size and/or weight of the device, and/or may facilitate single-handed operation of the device.

Some embodiments may also include guard plates disposed between the ends of the movable cylinder and the slot in which the axle portions are journaled, the guard plate being configured to prevent loose tobacco from the recess from entering the slot. In such embodiments of cigarette rolling devices, a guard plate may include a movement slot through which the axle portion extends, the movement slot configured to accommodate a path of movement of the axle portion of the translatable cylinder as the first cylinder is moved within the range of motion defined by the curvilinear slots. Optionally, the guard plate may be partially or wholly recessed in a corresponding recess in the support plate, or be otherwise disposed between the cylinder and the curvilinear slot.

Some embodiments of cigarette rolling devices according to the present disclosure may include a trough extending between the support plates, the trough having a top surface and a bottom surface, with the belt being trained around the cylinders and the trough, so that the portion of the belt forming the recess in which loose tobacco may be compressed is prevented from contacting other portions of the belt. In some embodiments, the trough may be configured to snap into one or more corresponding recesses on the base, and/or the trough may be configured to interconnect the support plates.

Some embodiments of cigarette forming devices according to the present disclosure also include a pushing device mounted for movement along an axis parallel to the cylinders, the pushing device including a pushing element adapted to engage and push one end of a shaped tobacco rod in the cylindrical recess toward one of the support plates, for example, to push the tobacco rod into a pre-formed cigarette tube. In such embodiments, the support plate may further include an opening and a nozzle disposed in the support plate, and optionally a nozzle guard to protect the nozzle from accidental damage and/or to facilitate visualization of the nozzle by a user. In various embodiments, the nozzle may extend in a direction away from the cylinders and may be configured to receive and retain one end of a pre-formed cigarette tube against the plate. The pushing device may thus be adapted to selectively push the tobacco rod from the recess into a pre-formed cigarette tube retained on the nozzle. In some embodiments, the pushing device may further be configured, after pushing the tobacco rod into the tube, to compress the tobacco rod into the tube.

In additional embodiments, the pushing device also may be configured to rotate around the fixed cylinder, and thus may be used to open and close the device (e.g., slide the translatable cylinder in the journaled slot). In these embodiments, when rotated about the axis of the fixed cylinder (e.g., away from the translatable cylinder), the pushing device may include a pushing element that exerts force on the translatable cylinder, causing it to move in it's journaled slots into an open position.

In various embodiments, the nozzle also may be associated with a clamping mechanism, which may be configured to hold the pre-formed cigarette tube in place against and/or around the nozzle. In some embodiments, the clamping mechanism may be used to retain the pre-formed cigarette tube on the nozzle, for example while the pushing device is being used to slide the tobacco rod into the pre-formed cigarette tube. In some embodiments, the clamping mechanism may be configured to be activated by a user without needing to alter the user's grip on the cigarette rolling device.

In some embodiments, the cigarette rolling device also may be configured to form a tobacco rod having a slightly asymmetrical (e.g., slightly conical) shape, wherein a first end of the tobacco rod has a slightly smaller diameter than the second end of the tobacco rod. In some embodiments, this asymmetrical shape may be achieved by varying the length of the slots at the first and second ends of the device, thus aligning the translatable cylinder slightly out of parallel with the fixed cylinder. In some embodiments, this slightly conical tobacco rod shape may ease the displacement of the rod through the nozzle and into the pre-formed cigarette tube.

These and other illustrative embodiments of cigarette rolling and/or forming devices may incorporate any combination of the features, components, and concepts discussed herein. Several illustrative, non-exclusive examples of cigarette rolling devices according to the present disclosure are disclosed below in connection with FIGS. 1-11. As explained in more detail with respect to each embodiment, the illustrative embodiments differ from each other primarily in terms of different mechanical configurations and features. Alternative configurations and/or variants of several of the embodiments may also be presented, such as to illustrate variations of structural components and arrangement of such components. The various embodiments, configurations, and methods disclosed in the paragraphs below are examples and should not be considered in a limiting sense, but merely for illustrative purposes of one or more of the aspects of the subject matter described herein. Numerous variations are possible and considered to be within the scope of this disclosure.

The cigarette rolling devices in FIGS. 1-11 are illustrated in somewhat simplified form as including a contoured or hourglass-shaped base from which opposing support plates extend, with at least two cylinders extending between the support plates. As discussed, these devices may alternatively incorporate different support structures such as those variously described, illustrated, and/or incorporated herein or otherwise consistent with the present disclosure. Similarly, any of the following illustrative examples of rolling devices may be utilized with any or all of the described features or components, may have any suitable relative size and shape, and may be incorporated into a handheld device or a larger mechanical system. It is within the scope of the present disclosure that components, subcomponents, and variants of the subsequently described FIGS. 1-11 may be used with other cigarette rolling devices within the scope of the present disclosure, such as those otherwise described and/or incorporated herein.

One illustrative and non-exclusive embodiment of a cigarette rolling device 100 is shown in FIGS. 1-5. This embodiment of a cigarette rolling device 100 includes a pair of support plates 101 (separately indicated at 101*a*, 101*b*) extending from a contoured or hourglass-shaped base 102, which may be coupled to each support plate 101*a*, 101*b*. In various embodiments, base 102 and support plates 101 together may form the outer edges of the device. As a matter of convenience, the support plates are sometimes referred to herein as "proximal" and "distal," with "proximal" used herein to indicate "relatively closer to the body of a user as typically held during use" (e.g., closer to the non-nozzle end), and signified by P in FIG. 1, and "distal" indicating "relatively farther from the body of a user as typically held during use" (e.g., closer to the nozzle end), and signified by D in FIG. 1. These conventions are used herein to describe the relative relationships between elements of all of the illustrated embodiments of the cigarette rolling device.

FIG. 4 is a side elevation view of the proximal end of the device of FIG. 1, with the device in an open configuration, and FIG. 5 is a side elevation view of the proximal end of the device of FIG. 1, with the device in a closed configuration. The support plates 101 are shown to be attached firmly to each other by way of base 102. As shown also in FIGS. 2, 4, and 5, the base may be connected to the support plates 101 at anchor points 105, such as by screws, rivets, or other mechanical linkages, or by any appropriate fastening means, to form a stable structure. As can be best seen in FIGS. 1 and 8, base 102 may have a curved, contoured, or generally "hourglass" shape, and a radiused portion 102*a*, which may provide clearance and or a convenient resting place for a user's fingers when opening and closing the device, forming the tobacco rod, and/or inserting the tobacco rod into a pre-formed cigarette tube. In some embodiments, the contoured, radiused, hourglass shape of base 102 also may reduce the size and/or weight of the device, and/or may facilitate single-handed operation of the device.

Figure 2:
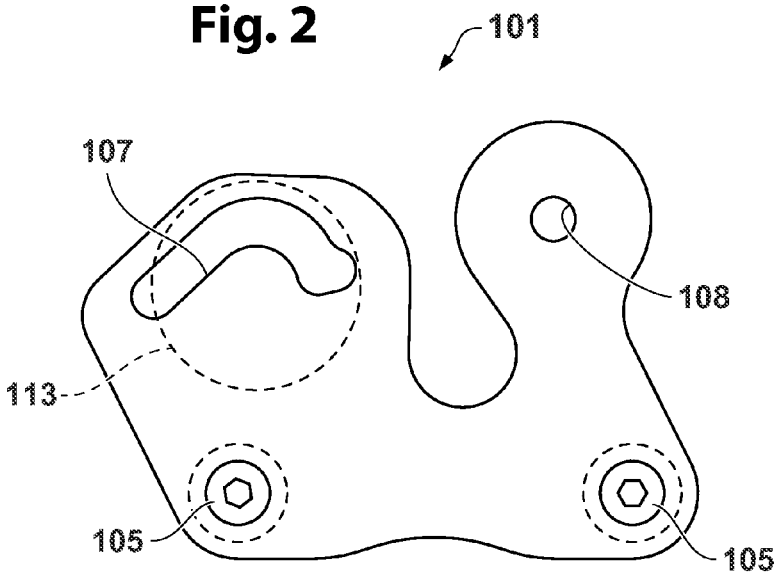
FIG. 2 is an elevation view of a proximal support plate of the cigarette rolling device of FIG. 1.
Figure 6:
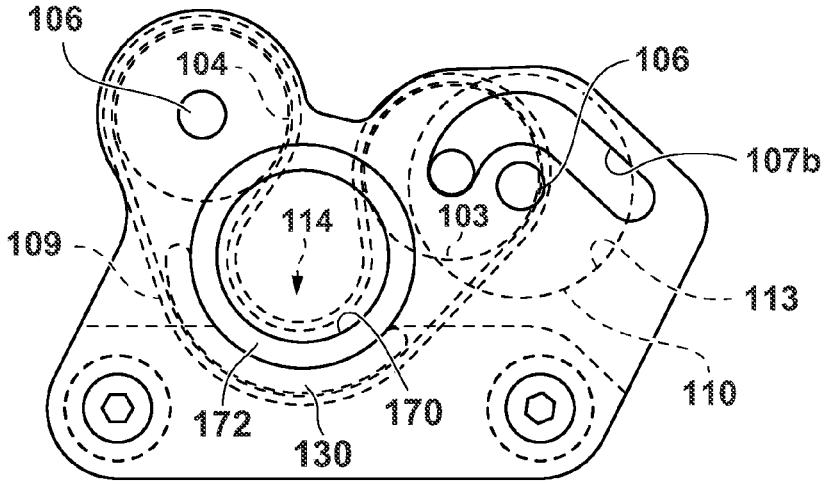
FIG. 6 is a side elevation view of the distal end of the device of FIG. 1, with the device in a closed configuration.

As shown best in FIG. 1 6, translatable cylinder 103 and fixed cylinder 104 are shown to be mounted to, and extending between, the support plates. In the illustrative embodiment 100, each cylinder is shown to include axle portions 106 protruding in a longitudinal direction from the ends of the cylinder, the axle portions being mounted or otherwise rotatably coupled to the support plates. In particular, and as shown in FIG. 2, each support plate is shown to include a slot 107 in which the axle portions of translatable cylinder 103 are journaled, and a mounting site 108 (shown as a hole) in which the axle portions of fixed cylinder 104 are journaled. Slot 107 and mounting site 108 may allow cylinders 103 and 104, respectively, to be rotated relative to the support plates.

As shown in FIGS. 4 and 5, in device 100, mounting site 108 may allow fixed cylinder 104 to be rotatable about a single, fixed axis defined by the placement of the axle portions relative to the support plates. As such, the mounting site may include any rotatable linkage; for example, instead of a hole through the support plate (as shown), a recessed portion into the proximal surface of the support plate may be used, or a stud or other mount that protrudes proximally from the support plate surface to rest within a corresponding depression-shaped axle portion on fixed cylinder 104. Such variations are considered to be within the scope of this disclosure.

Slot 107*a* allows translatable cylinder 103 be selectively translatably moved relative to the support plates (and relative to fixed cylinder 104), through a range of motion defined by the size and shape of the slot, by sliding the axle portions of translatable cylinder 103 along the slots. Thus, translatable cylinder 103 is configured to be rotatable about a non-fixed axis.

As described in greater detail below, the inverted "J" shape of the slot shown in FIGS. 4 and 5 may provide stability when shaping a quantity of loose tobacco in a belt trained around the cylinders, such as by retaining the translatable cylinder 103 in (or otherwise preventing or reducing inadvertent movement of the translatable cylinder 103 from) a desired position in the slot, such as that shown in FIG. 5. As such, the slot may have any desired configuration. For simplicity, the slots in the illustrated embodiments are all shown to have a generally curvilinear configuration, and may be referred to herein as "curvilinear slots" for convenience and clarity, such as to distinguish among other types of slots described herein. However, the slots may be curved, straight, or otherwise shaped, in various embodiments and alternative configurations of various embodiments, so the term "curvilinear slots" is not meant to be restrictive. Further, some configurations may include a slot-shaped recess in the proximal surface of the support plates, instead of a slot through the support plates (as shown), or a slot that includes portions that extend all the way through the support plate and recessed portions, and so forth, and such variations are considered to be within the scope of this disclosure.

Figure 7:
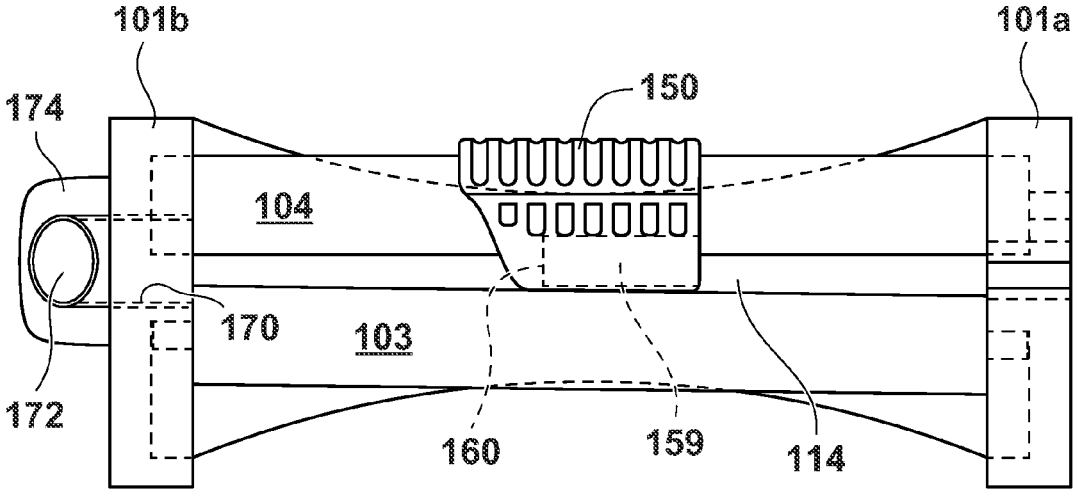
FIG. 7 is a top view of the device of FIG. 1 in a closed position.

Turning now to FIG. 6, which is a side elevation view of the distal end (e.g., the nozzle end) of the device of FIG. 1, and FIG. 7, which is a top view of the device of FIG. 1 in a closed position, in some embodiments, slot 107*b* may be slightly longer than corresponding slot 107*a*, or may be positioned slightly closer to fixed cylinder 104 that corresponding slot 107*a*, which is shown in FIGS. 4 and 5. This asymmetry in slot length and/or position results in translatable cylinder 103 being positioned slightly out of parallel with respect to fixed cylinder 104 when the device is in a closed position (see, e.g., FIG. 7). This asymmetry results in a tobacco rod having a very slightly tapered or conical shape, which may facilitate dislodging of the formed tobacco rod from the device. In various embodiments, the degree to which translatable cylinder is out of parallel with fixed cylinder 104 may be between about 1 degree and 15 degrees, for example about 5-10 degrees out of parallel. In some embodiments, this angle may be adjusted by a user by varying the position of the translatable cylinder 103 with regard to slot 107*b* when the device is in a closed position.

Returning to FIGS. 4 and 5, rolling device 100 is also shown in FIGS. 4 and 5 to include a looped belt 109 trained around the cylinders. The belt is shown to be somewhat loose, with the portion of the belt disposed between the cylinders forming a recess, indicated at 114. In various embodiment, this recess may be relatively broad and shallow when cylinder 104 is spaced away from cylinder 103 (e.g., when the device is in an open position, see e.g., FIG. 4), and substantially cylindrical when the cylinders are substantially adjacent each other (e.g., when the device is in a closed position, see, e.g., FIG. 5).

Figure 9:
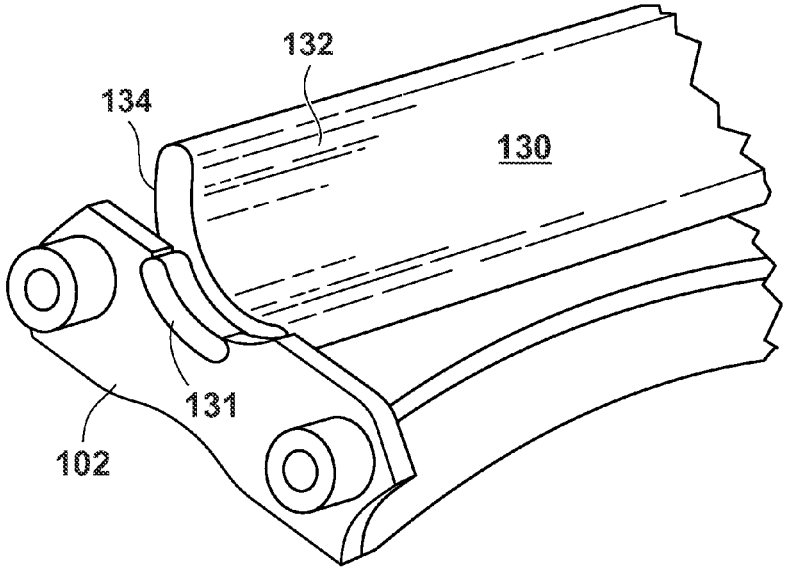
FIG. 9 is a perspective view of a base and a trough.

As can be seen in FIGS. 4 and 5, as well as in greater detail in FIG. 9, the device also may include a trough 130 extending from a corresponding notch 131 in base 102. The trough is shown to have a U-shaped or semicircular cross-section, with a first or inner surface 132, and a second, or outer, surface 134 (see, e.g., FIG. 9). As can be seen in FIGS. 4-6, one layer of belt 109 is shown to be trained around the outer surface of the trough, which is thus disposed between the portion of the belt forming the recess and the portion surrounding the recess portion.

The trough may facilitate efficient use of the device, for example, by reducing drag. For example, if the trough were not present, the portion of the belt that forms the recess may be urged toward, or even against, the other layer of the belt that moves in the opposite direction of the portion forming the recess, when a quantity of loose tobacco is being shaped in the recess via rolling of the belt. The inner surface of the belt may further have a texture to reduce the amount of friction generated when portions of the surface slide or contact each other. However, in some circumstances, the inner surface of the belt that slides against itself when the two layers are moved in opposite directions may eventually become worn from repeated use, and/or create drag that interferes with rolling, due to two surfaces moving relative to each other. Moreover, moisture or loose tobacco particles may cause layers of the belt to bind or otherwise adhere to each other, pulling both layers in the same direction, which may lead to binding of the cylinders, creasing or tearing the belt, or other mechanical interference or damage to the device.

Also, distensions or other irregularities in the belt surface may in turn lead to uneven rolling of a leaf of cigarette paper around a shaped tobacco rod, or may create creases and folds in a leaf of cigarette paper, which many users may find undesirable. The trough may thus reduce or prevent drag by providing a stable sliding surface for one layer of the belt, or otherwise preventing the portion of the belt forming the recess from rubbing or sliding against, or otherwise contacting, other portions of the belt, such as a layer of the belt moving in the opposite direction when the belt is rolled.

As mentioned briefly above, a quantity of loose tobacco is compressed and shaped into a tobacco rod by rolling the belt, as the tension of the belt itself, in addition to forces urging the tobacco against surfaces over which the belt is moved. The trough may function to increase the tension of the belt (or reduce slack) overall or when the cylinders are in the closed configuration, by providing another surface around which the belt is trained. Increasing the tension of the belt may in turn provide stability to the device and/or increase consistency of cigarettes produced using the device by positionally stabilizing the cylindrical recess formed when the cylinders are in the closed configuration. In such configurations, only the portion of the belt trained around the outer surface of the trough may come in contact with the trough.

In some configurations, such as those in which the portion of the belt forming the recess comes in contact with a trough (such as the inner surface of the trough), the trough may facilitate forming of a tobacco rod by providing a support surface against which the tobacco in the recess may be urged when the belt is moved over the cylinders (or rolled around the rollers). The roller surfaces and the surface tension of the unsupported portion of the belt itself collectively provide a compressive force on the tobacco in the cylindrical recess, but repeated use over time may tend to stretch the belt so that the surface tension is weakened, or the belt is slackened sufficiently, and so forth, so that the belt may become unsuitable for compressing tobacco. As such, the support trough in such configurations may provide a support surface against which the belt may be urged, which may reduce or even prevent distension of the belt via the compressive force delivered to the tobacco in the recess by the cylinders.

Optionally, the trough may function to establish the diameter of a finished cigarette, such as by providing a support surface of constant diameter, and/or by increasing the tension of the belt surface, as discussed above, either of which may assist a user in determining the correct quantity of loose tobacco to use. By reducing or preventing variation in the diameter of tobacco rod shaped in the device, a user can be assured of relatively consistent results, which may in turn reduce waste if the tobacco rod produced is too large for a standard pre-formed cigarette tube to surround. The trough may thus have any configuration, shape, thickness, cross-section, and so forth, suitable to achieve any of the aforementioned results. For example, alternative configurations may include a flatter or more curved cross-section than that shown (e.g., a semi-circular cross section with a different diameter), be a different thickness, and so forth, as well as be of composite construction and/or discontinuous construction. Furthermore, in some embodiments, the trough may help align the axis of the tobacco rod formed in the recess of the belt with the axis of the nozzle. In some embodiments, without the backup support and alignment the trough provides, the tobacco rod might fail to align with the nozzle, and thus might not be displaceable by the pushing device through the nozzle.

As shown in FIGS. 3, 4, and 5, device 100 may also include a pair of guard plates 110, each of which is disposed between an end of the translatable cylinder 103 and the curvilinear slot 107. As can be seen in FIGS. 2 and 3, in some embodiments, each support plate 101 may include a circular recess 113 in which each guard plate 110 may be at least partially seated. However, in other embodiments, support plate 101 may not include this circular recess, and each guard plate 110 may be at seated adjacent support plate 101, rather than recessed into support plate 101.

As shown in FIG. 3, guard plate 110 may include an axle portion 116, which is journaled within a mounting site on the support plate 101. Guard plate 110 also includes a movement slot 111, through which axle portion 106 of translatable cylinder 103 extends; as such, guard plate accommodates movement of translatable cylinder 103 while preventing loose tobacco from the recess 114 from entering the curvilinear slot 107. Although two guard plates are shown, other embodiments of a cigarette rolling device may include only one guard plate, or even multiple guard plates.

As can be seen in FIG. 4, about half of the curvilinear slot 107 overlaps recess 114 in at least the "open" configuration and in at least part of the range of movement of cylinder 103. Loose tobacco typically includes a sufficient amount of moisture such that stray pieces of tobacco may have a tendency to stick to, clog, or otherwise interfere with moveable components of a cigarette rolling device, which may in turn interfere with intended operation and require periodic cleaning. As configured, however, the guard plate 110 of cigarette rolling device 100 is disposed between the end of the cylinder and the curvilinear slot, preventing loose tobacco from the recess 114 from entering the slot 107, while allowing movement of the translatable cylinder 103 between open and closed configurations. Guard plate 110 may thus be configured as desired to prevent loose tobacco from the belt, or more particularly from the recess formed by the portion of the belt between the cylinders, from entering the curvilinear slot, while accommodating movement of the axle portion as the cylinder is moved back and forth. In general, embodiments incorporating one or more pairs of curvilinear slots and one or more cylinders journaled for slidable movement therein, the shape of the guard plate, and/or the configuration of the movement slot in a guard plate, may relate to such factors as the shape and/or length of the slot, the relative size(s) of the moveable cylinder (s), and so forth.

As described above, although device 100 may be used to roll cigarettes in cigarette papers, which typically come in books of packets of flat leaves, pre-formed cigarette tubes are also commercially available, for example if a user prefers to hand-roll a tobacco rod, but does not want to roll a leaf of cigarette paper around the tobacco rod. Some commercially available cigarette tubes also include filter tips positioned within the otherwise empty tube, into which a user may place a shaped tobacco rod. Thus, embodiments of a cigarette rolling device may instead include a mechanism by which a tobacco rod shaped in the cigarette rolling device, as explained in detail above, may be pushed or injected into a pre-formed cigarette tube.

Figure 11A:
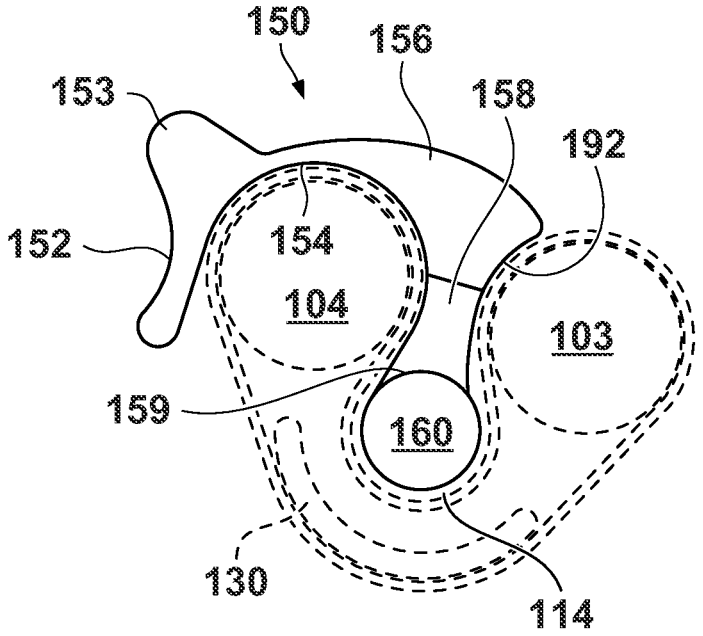
FIGS. 11A and 11B are a partial cutaway view of the device of FIG. 1, showing a close-up side view of the pushing device, with the translatable cylinder in a closed position (FIG. 11A), and a partial cutaway view of the device of FIG. 1, showing a close-up side view of the pushing device, with the translatable cylinder in an open position (FIG. 11B); all in accordance with various embodiments.
Figure 11B:
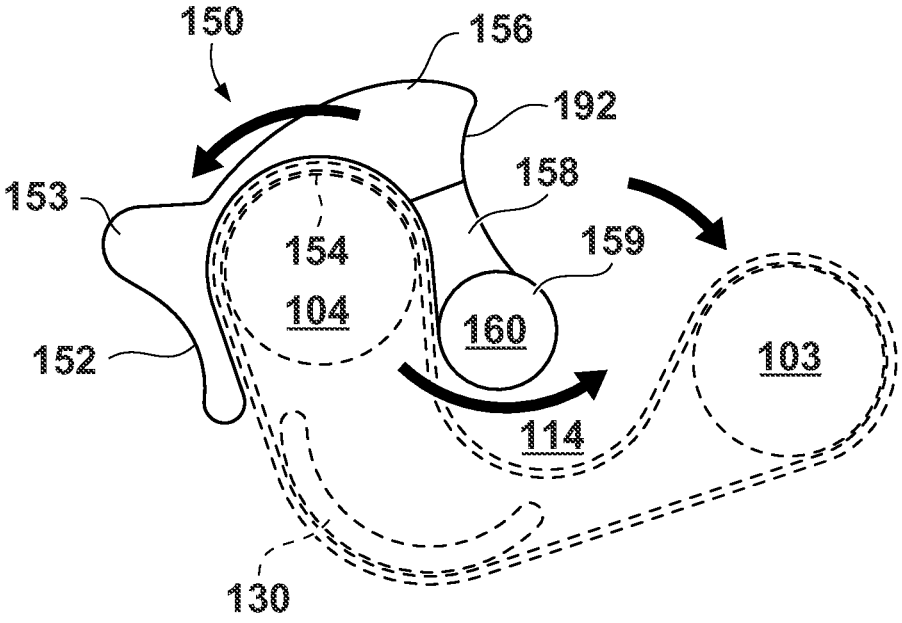

As shown in FIG. 7, and as shown in greater detail in FIGS. 11A and 11B, device 100 may also include a pushing device 150 mounted for movement relative to the cylinders 103, 104 along an axis parallel to the cylinders, and optionally, mounted for movement relative to the fixed cylinder about an axis parallel to the fixed cylinder 104. Pushing device 150 includes an outer surface 152 and an inner surface 154, the inner surface further including a collar portion 156 which is shaped to removably clamp to fixed cylinder 104 to retain the pushing device on the cylinder, but to also allow slidable movement of the sliding device therealong. The outer surface is shown in FIGS. 11A and 11B to include a tab 153 that provides for ease of both slidable and rotational movement, for example, by a user's thumb or index fingers, but the outer surface may have any suitable configuration.

In various embodiments, an arm 158 is shown to extend from the collar portion 156 in a direction such that when pushing device is mounted on fixed cylinder 104, the arm descends generally into a recess 114 formed by the portion of the belt 109 trained around the cylinders 103, 104. An extension 159 protrudes from the arm, for example at a right angle in some embodiments, and terminates in a substantially circular pushing element 160. So configured, the pushing element is adapted to engage and push the end of a shaped tobacco rod in the cylindrical recess, for instance by sliding the pushing device along the cylinder. More particularly, the pushing device is adapted to be slid toward one support plate, designated as the "distal" support plate, from the direction of the other, "proximal" support plate, and back again. In other words, if the pushing device is initially positioned near the proximal support plate, when a tobacco rod is shaped in the cylindrical recess, sliding the pushing device toward the distal support plate will engage the pushing element with the end of the tobacco rod and push the end of the tobacco rod toward the first support plate, to longitudinally compress the tobacco rod.

As mentioned above, "tapping" or compressing the end of a shaped tobacco rod may more securely pack the tobacco into a cylindrical form, making the tobacco rod less likely to break apart and/or to reduce or even prevent loose tobacco from flaking away or otherwise coming loose from the tobacco rod. As such, longitudinal compression may allow a cigarette to last longer in storage, without tobacco coming loose from the end of the cigarette. Compression of one or both ends of a tobacco rod may also provide a flat surface against which cigarette paper, or the end of a cigarette tube, may be folded, such as to hold tobacco in the paper or tube while the cigarette is being held, stored, or smoked, and/or simply for aesthetic effect.

In addition to slidable movement, the collar portion 156 and inner surface 154 are configured to move in a predetermined range of rotatable movement about the cylinder to which the device 150 is clamped, such as to ensure stability of the pushing device on the cylinder 104. For example, in some embodiments, as cylinder 103 is moved from a "closed" position to an "open" position, the portion of the belt trained between the cylinders moves from defining a relatively deeper, cylindrical recess to defining a broader, relatively shallower recess. As this belt portion moves from one configuration to the other, it may push against the portion of the pushing device within the recess (e.g., the pushing element 160, the extension 159, and/or the pushing device arm 158). However, the collar portion 156 and inner surface 154 of the pushing device are configured to allow the pushing device to "rock" back and forth on the cylinder, for example to accommodate the movement of the belt when the cylinders are moved between "open" and "closed" configurations, without becoming detached therefrom.

In various embodiments, pushing device 150 also may include an outrigger portion 192 extending from collar portion 156 and configured to limit rotation of pushing device 150 about fixed cylinder 104 by coming in contact with the portion of belt 109 that is wrapped around translatable cylinder 103. This configuration allows outrigger portion 192 to prevent over-rotation of pushing device 150 about fixed cylinder 104, which otherwise might allow the pushing device 150 (and particularly the pushing element 160, the extension 159, and/or the pushing device arm 158) to pinch belt 109 against trough 130.

Additionally, outrigger portion 192 may serve to orient the axis of the pushing element 160 and align it to the axis of the formed tobacco rod. Additionally, in various embodiments, outrigger portion 192 may provide stability to the pushing device 150, as well as providing an additional slide bearing surface that reduces overall contact pressure of the pushing device 150 against belt 190 when extending it to displace the tobacco rod.

Figure 8:
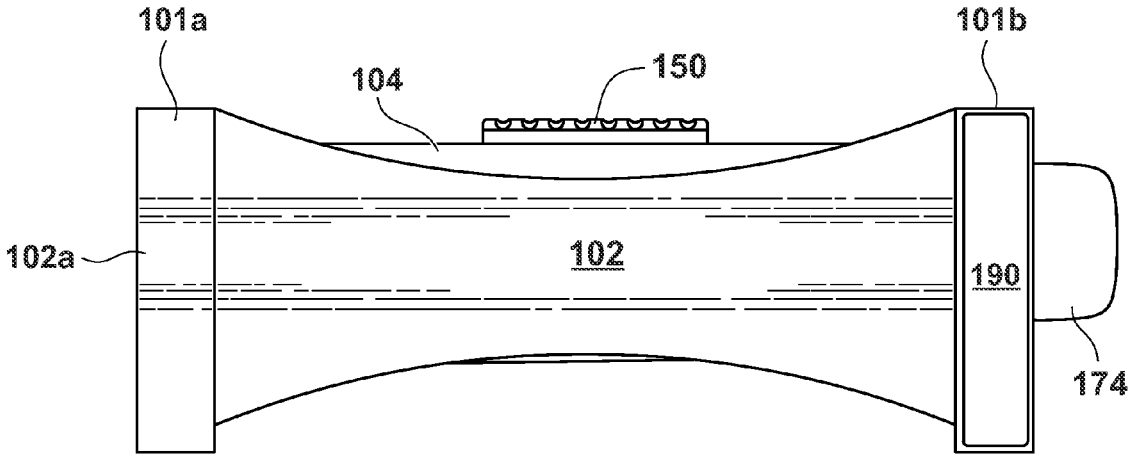
FIG. 8 is a bottom view of the device of FIG. 1.

In some embodiments, such as the embodiment illustrated in FIGS. 11A and 11B, the collar portion 156 may be configured to rotate outward and away from translatable cylinder 103 along the longitudinal axis of fixed cylinder 104, for example when tab 153 is depressed by a user. In some embodiments, this rotation of the collar portion may result in the portion of the pushing device within the recess (e.g., the pushing element 160, the extension 159, and/or the pushing device arm 158) exerting sufficient pressure against translatable cylinder 103 to cause the translatable cylinder to move along slots 107 into an open position (see, e.g., FIG. 11B). This feature may allow a user to conveniently "flip" the device into an open position, for example to receive tobacco in recess 114, and may be accomplished with a single hand. As illustrated in FIG. 8, pushing device 150 typically may be moved into a center position along the longitudinal axis of fixed cylinder 104 prior to being rotated about the longitudinal axis of fixed cylinder 104, so that it may exert approximately equal pressure on both the proximal and distal ends of translatable cylinder 103. However, one of skill in the art will appreciate that in some embodiments, pushing device may be used to open device 100 in any position along fixed cylinder 104.

In various embodiments, proximal support plate 101*a* may be configured to receive and house at least a portion of pushing device 150, such as to allow the pushing device to be moved substantially out of recess 114 while a quantity of loose tobacco is being shaped into a tobacco rod, so as not to interfere with the rolling process. In various embodiments, therefore, proximal support plate 101*a* thus may include a recess for receiving a portion of pushing device 150. As such, the pushing device may be selectively moved to the support plate, housing a portion thereof within the recess in the support plate, so that after a tobacco rod is formed, the pushing device may be deployed to urge the pushing element against the end of the tobacco rod.

As such, in some embodiments, a pushing device as described above may function as a compression element, such as to longitudinally compress the tobacco rod. However, as may be seen in FIGS. 6 and 7, some embodiments of the cigarette rolling device may also include an opening 170 in the distal support plate 101*b*, and a corresponding nozzle 172 disposed on the support plate that couples to or extends through the opening. In various embodiments, the nozzle 172 may have a circular cross-section and may be positioned on the distal support plate 101*b* to be aligned with the substantially circular recess 114 formed by the belt 109 when the cylinders 103, 104 are in a "closed" configuration, such that the contents of the cylindrical recess 114 (such as a shaped tobacco rod) may be pushed through the opening 170 and the nozzle 172, when the pushing device 150 is slid from the proximal support plate 101*a* toward the distal support plate 101*b*. In the some embodiments, the nozzle may be mounted to the support plate by means of a retaining rim on support plate, but any suitable mounting method may be used.

The size of the cross-section of the nozzle is such that an end of pre-formed cigarette tube (not shown) may be fitted snugly over the nozzle and retained against the support plate. As such, after a quantity of loose tobacco has been shaped into a compressed tobacco rod in the substantially cylindrical recess formed by the belt, sliding the pushing device from the second support plate toward the first support plate functions to engage the pushing element with the end of the tobacco rod and urges the tobacco rod through the opening 170 and nozzle 172, and into the cigarette tube retained against the first support plate, to form a cigarette. In some embodiments, a nozzle guard 174 may be used in conjunction with the nozzle 172, for example to protect the nozzle from accidental damage during transport, but also to serve as a visual guide to assist a user in fitting the pre-formed cigarette tube over the nozzle. In some embodiments, nozzle guard 174 may have a contrasting color when compared with nozzle 172, for instance to help make nozzle 172 more visually distinct.

Also, in various embodiments, sliding the pushing device 150 to the extent of the movement allowed by the distal support plate 101*b* may project at least a portion of the pushing element 160 partially through the opening 170, by means of extension 159 on arm 158. When the length of the cylinders corresponds to the length of the cigarette tube, this configuration thus may allow the tobacco rod, once injected into the cigarette tube, to be further compressed or "tapped" into the tube. Optionally, of course, the pushing device also may be used to push bits of loose tobacco from the belt, for example to clean the belt of the device between uses.

Figure 10A:
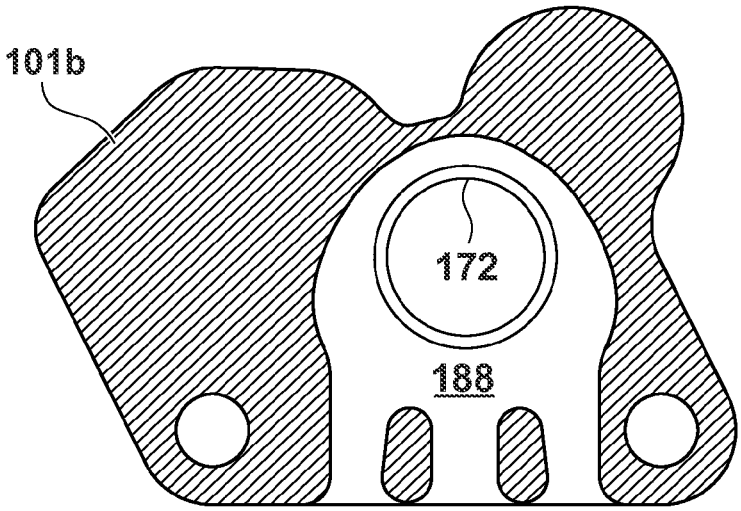
FIGS. 10A-10C are three perspective views of a distal support plate having a recess for a clamping device (FIG. 10A), the distal support plate of FIG. 10A with the clamping device in an open position (FIG. 10B), and the distal support plate of FIG. 10A with the clamping device in closed position (FIG. 10C)
Figure 10B:
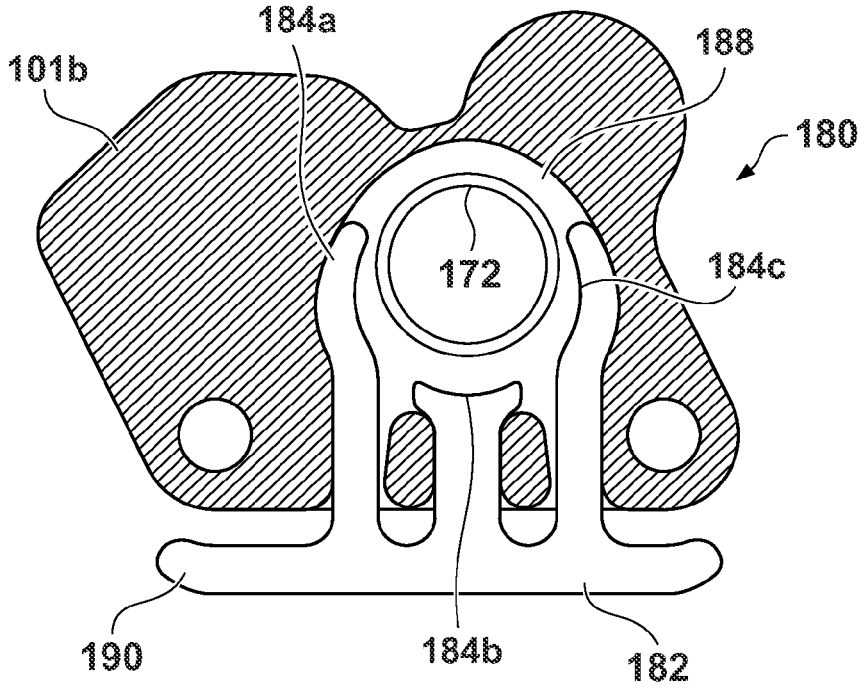
Figure 10C:
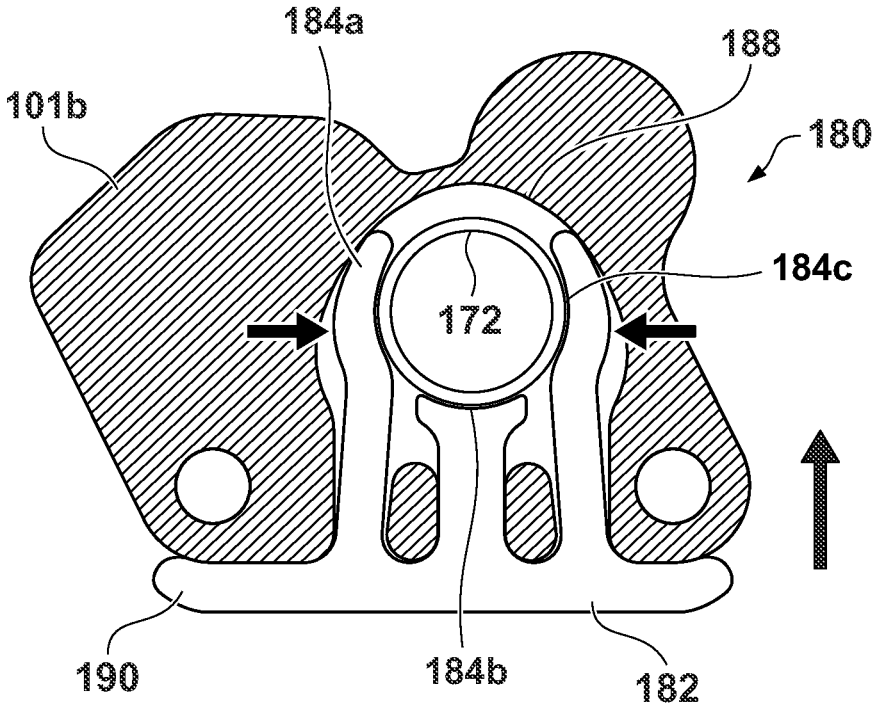

Turning now to FIGS. 10A-10C, some embodiments of the device also include a clamping device 180 that is selectively operable to retain a pre-formed cigarette tube on the nozzle 172. Although any suitable configuration may be used, clamping device 180 is shown in FIGS. 10A-10C to include a three-pronged clamping element 182 housed within distal support plate 101*b*, the clamping element terminating in two or more clamping surfaces 184*a*, 184*b*, 184*c* that are shaped to hold an end of the tube against the exterior surface of the nozzle 172. Clamping element 182 may be biased away from nozzle 172 by means of an internal biasing element (which in the illustrated embodiment is clamping element 182), such that pressing a button 190 at the other end of clamping element 182 urges a trio of clamping surfaces 184*a*, 184*b*, 184*c*, against the nozzle 172, securing a pre-formed cigarette tube in place, such as for receiving a tobacco rod from the device 100. In some embodiments, three-pronged clamping element 182 may travel within a recess 188 within the distal support plate 101*b*, and actuation of button 190 may force the outer two 184*a*, 184*c* of the three clamping surfaces against the sides of recess 188, thus urging force the outer two 184*a*, 184*c* of the three clamping surfaces inward, and against the exterior surface of nozzle 172. The inner clamping surface 184*b* may simultaneously be pressed against the underside of nozzle 172. Thus, in the illustrated embodiment, clamping device 180 exerts pressure on three sides of nozzle 172. Although a three-pronged clamping member is illustrated herein, one of skill in the art will also appreciate that such clamping mechanisms may be used that have one, two, three, or even more clamping surfaces.

The overall structural configuration of a cigarette rolling device 100 having been explained, an illustrative explanation of the use of such a device, in general, is given in the paragraphs below. In the following explanation, several of the individual components are further discussed, as well as variations to the structural configuration and some components of the illustrated embodiments. All of such variations are considered to be within the scope of this disclosure.

In use, such as to roll a cigarette, a user may first move cylinder 103 away from cylinder 104, such as by applying force to the tab 153 on pushing device 150 sufficient to cause the portion of the pushing device within the recess (e.g., the pushing surface 160, the extension 159, and/or the pushing device arm 158) to exerting sufficient pressure against translatable cylinder 103 to cause the axles 106 of translatable cylinder 103 to move along slots 107 into an open position. One of skill in the art will appreciate that the device may be opened in other ways, even if pushing device 150 is present, such as by applying pressure directly to translatable cylinder 103 or to the belt 109 trained around the cylinder.

As mentioned above, the configuration of the slot 107 may be suitable to provide a desired amount of ease of movement of cylinder 103, such as by restricting or allowing freedom of movement along the slot; to provide a desired range of separation of the cylinders when cylinder 103 is moved near to or away from cylinder 104; and so forth. Additionally, as described in greater detail above, the two slots 107*a*, 107*b* may be of different lengths, or may be positioned differently on support plates 101*a*, 101*b*, such that the cylinders 103, 104 are not quite parallel to one another. In particular, the cylinders 103, 104 may be spaced more closely together at the distal end (e.g., the nozzle end) of the device when the device is in the closed position, so as to create a slightly cone-shaped tobacco rod, for instance to ease displacement of the formed tobacco rod out of recess 114 through the nozzle 172. Thus, even though the slots in the illustrated embodiments are all shown, in general, to have an inverted "J" shape, any desired shape may be used, and the slots may be of different lengths or have different positioning with respect to one another.

A user may then place a quantity of loose tobacco on the portion of the belt 109 between the cylinders 103, 104, and may prepare to shape the loose tobacco into a tobacco rod by moving the translatable cylinder 103 toward the fixed cylinder 104, into a "closed" configuration, as shown in FIG. 5. Throughout the disclosure, the term "substantially adjacent" is used to describe the relative positions of the cylinders in this configuration, the term indicating that the cylinders are positioned close enough together so that loose tobacco placed in the recess shapes the recess into a substantially cylindrical form when the cylinders are urged into this configuration, but still spaced to provide sufficient clearance so that the portions of the belt trained over each cylinder do not come into contact when the belt is moved.

"Substantially cylindrical," in turn, signifies a shape with a relatively constant and substantially circular cross-section, such that a quantity of loose tobacco, when rolled in such a substantially cylindrical recess, is formed into a cylindrical shape, also referred to herein as a "tobacco rod." As can be seen in FIG. 5, the cross-section of the recess 114 when the cylinders are substantially adjacent is slightly teardrop-shaped, with the point of the teardrop extending to the space between the cylinders. However, the movement of the belt over the cylinders compresses any loose tobacco in the tip area into a cylindrical shape.

In general, a quantity of loose (uncompressed) tobacco sufficient to form a cigarette will occupy a greater volume than when compressed, and, when the cylinders are moved into the "closed" configuration, will urge the belt outward into the substantially cylindrical shape shown in FIG. 5. The size and cross-section of the cylindrical recess 114, for a given quantity of loose tobacco, may be determined by factors such as the length of the belt 109 relative to the configuration of the cylinders 103, 104, the elasticity of the belt, the size of the cylinders, and so forth. As such, the belt (and the cylinders) may be configured as desired to provide a tobacco rod of desired dimension and/or desired compression. For example, the belt may be longer or shorter than as shown, and/or elastic or non-elastic, such as to form a differently-sized cylindrical recess in which the tobacco may be compressed.

After a quantity of loose tobacco is placed on the belt 109, and the cylinders have been moved to a "closed" configuration, the belt may be moved over the cylinders to shape the loose tobacco into a tobacco rod. As can be seen in FIG. 5, the portion of the belt forming recess 114 will "roll" the loose tobacco as the belt is moved over the cylinders, via the force exerted on the tobacco by the surface tension of the portion of the belt forming the cylindrical recess, and any surfaces against which the belt is urged (for example, the lower portion of the belt against which the cylindrical recess portion is slid, the surfaces of the cylinders, and so forth).

In the cigarette rolling devices illustrated herein, the cylinders (such as cylinders 103, 104) are all shown to be rotatably mounted to the support plates, and thus may be rolled in either direction to move the belt and compress the tobacco. As such, such cylinders may also be referred to herein as "rollers." Rotating the cylinders may allow easy movement of the belt over the cylinders. However, one or more of the cylinders may instead be nonrotatably mounted, for example in embodiments in which the belt may be slid over the one or more nonrotatable cylinders. For example, an alternative configuration may include a nonrotatable cylinder in place of cylinder 104, together with a rotatable cylinder such as translatable cylinder 103, or any desired combination of rotatable and nonrotatable cylinders.

The surfaces of the cylinders thus may be textured to provide a desired degree of friction against the belt. The belt may also (or alternatively) have a textured outer and/or inner surface, such as to provide a desired degree of friction when moved over the cylinders and/or against the tobacco. In embodiments incorporating rotatable cylinders (or rollers), for example, the surface of the belt that is urged against the surface of the rollers may be textured or otherwise fabricated to assure a "grip" of the belt over the rollers, such that a user may be able to roll the rollers by exerting force on the belt. In embodiments incorporating nonrotatable cylinders or structures around which the belt is slid, the surface of the belt that moves against such cylinders may be smoothly textured or otherwise configured to reduce drag. Also, the surface of the belt that is urged against the tobacco may be textured or otherwise fabricated to "grip" the loose tobacco, such as to facilitate compression as the belt is rolled around the tobacco, as desired.

In configurations that incorporate nonrotatable cylinders, a "cylinder" may be configured to have a partially cylindrical or even geometrically noncylindrical shape, and consist of one or more surfaces over which the belt may be slid. Such surfaces may have a partially cylindrical or curved shape, such as to facilitate sliding, or any desired geometry to provide a sliding surface, and/or a surface against which the belt may be urged in order to compress a quantity of loose tobacco into a tobacco rod when the belt is moved over the cylinders. Such variations are considered to be within the scope of this disclosure, and, as such, are considered to be within the scope of the term "cylinder," as used herein. For the sake of clarity, however, all of the illustrated embodiments are shown to include rotatably mounted cylinders.

After the belt has been moved over the cylinders to compress the tobacco into a tobacco rod, a user may place a pre-formed cigarette tube over nozzle 172, and optionally may depress button 190 in order to activate the clamping device 180 and hold the pre-formed cigarette tube in place. Longitudinal pressure may then be applied to pushing device tab 153 to slide the collar portion 156 of pushing device 150 from the proximal end to the distal end of fixed cylinder 104, which simultaneously advances the pushing device arm 158, extension 159, and substantially circular pushing surface 160 within recess 114. This movement pushes the formed tobacco rod through opening 170 and nozzle 172 into the pre-formed cigarette tube. Once the tobacco rod has been inserted into the pre-formed cigarette tube, further sliding of pushing device 150 may cause the tobacco rod to be tamped within the tube as described above in greater detail.

Alternately, a user may insert one end of a piece (or "leaf") of cigarette paper between the cylinders and continue moving the belt, to roll the paper received between the cylinders around the tobacco rod. Cigarette papers are commercially available in several standard sizes, and the overall width of the cylinders may be appropriate, in various embodiments, to accommodate leaves of various sizes. Commercially available cigarette papers are usually gummed along one edge, or include some other adhesive property, so that when the gummed edge is oriented to be the trailing edge of the leaf as it is rolled around the tobacco rod, the gummed edge adheres to the surface of a portion of the paper already rolled. As such, if such a cigarette paper is used in the rolling device, a user may stop rolling and moisten the trailing, gummed edge prior to rolling the paper completely around the tobacco rod. Once the paper is rolled around the rod, the cylinders may be moved into the "open" configuration and the formed cigarette may be removed.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A cigarette forming device comprising:

a base with first and second support plates extending therefrom;

a translatable cylinder and a fixed cylinder extending between the support plates and rotatably mounted thereto, the translatable cylinder being translatably moveable between a first position in which the translatable cylinder is spaced from the fixed cylinder, and a second position in which the translatable cylinder is substantially adjacent to the fixed cylinder;

a looped belt trained around the translatable and fixed cylinders, wherein a portion of the belt between the translatable and fixed cylinders forms an open recess adapted to receive a quantity of loose tobacco when the translatable cylinder is in the first position, and wherein the portion forms a substantially cylindrical recess in which the tobacco may be shaped into a tobacco rod when the belt is moved about the translatable and fixed cylinders when the translatable cylinder is in the second position;

a pushing device slidably and rotatably coupled to the fixed cylinder and configured for movement around and along the fixed cylinder, wherein the pushing device comprises an pushing element adapted to engage and slidably push one end of a shaped tobacco rod in the cylindrical recess toward the first support plate, and wherein rotation of the pushing device about the fixed cylinder causes the pushing element to move the translatable cylinder from the second position to the first position.

2. The cigarette forming device of claim 1, wherein the first support plate further includes an opening and a nozzle disposed thereon, the nozzle being configured to receive and retain one end of a pre-formed cigarette tube thereupon, and wherein the pushing device is adapted to selectively push the shaped tobacco rod from the recess, through the nozzle, and into the pre-formed cigarette tube.

3. The cigarette forming device of claim 1, wherein the pushing device further includes a collar portion adapted for slidable movement along the fixed cylinder, the collar portion including an arm extending therefrom and generally into the recess formed by the portion of the belt between the translatable and fixed cylinders, and wherein the pushing element is disposed on the arm.

4. The cigarette forming device of claim 3, wherein the pushing device further includes an extension disposed on the arm, the extension extending towards the nozzle, and wherein the pushing element is disposed on an end of the extension.

5. The cigarette forming device of claim 1, wherein one of the first and second support plates includes a recess, and wherein the pushing device is adapted to selectively move at least a portion of the arm, extension, and/or pushing element into the recess.

6. The cigarette forming device of claim 3, wherein the collar portion is configured to removably clamp to the fixed cylinder for slidable and rotational movement thereon.

7. The cigarette forming device of claim 2, further comprising a clamping device selectively operable to retain the pre-formed cigarette tube on the nozzle.

8. The cigarette rolling device of claim 1, wherein the first and second support plates include corresponding first and second slots; wherein the translatable cylinder includes axle portions protruding from each end, each axle portion being journaled in one of the slots for slidable movement therein.

9. The device of claim 8, wherein the first slot is shorter than the second slot.

10. The device of claim 9, wherein the translatable cylinder is positioned slightly out of parallel with the fixed cylinder when the translatable cylinder is in the second position.

11. The device of claim 8, wherein the device further includes a guard plate disposed between one end of the translatable cylinder and first slot, the guard plate being configured to prevent loose tobacco from the recess from entering the first slot.

12. The cigarette rolling device of claim 1, further including a trough extending between and interconnecting the first and second support plates, the trough having a top surface and a bottom surface; and wherein the looped belt is trained around the translatable and fixed cylinders and the trough;

wherein the recess is formed by a portion of the belt between the translatable and fixed cylinders; and wherein the trough is adapted to prevent the portion of the belt forming the recess from contacting other portions of the belt.

13. The cigarette rolling device of claim 1, wherein the base is contoured in an hourglass shape.

14. A cigarette forming device comprising:

a base with first and second support plates extending therefrom; first and second parallel cylinders extending between the first and second support plates and rotatably mounted thereto, the first cylinder further being translatably moveable between a first position in which the first cylinder is spaced from the second cylinder, and a second position in which the first cylinder is substantially adjacent to the second cylinder;

a looped belt trained around the first and second cylinders, wherein a portion of the belt between the first and second cylinders forms an open recess adapted to receive a quantity of loose tobacco when the first cylinder is in the first position, and wherein the portion forms a substantially cylindrical recess in which the tobacco may be shaped into a tobacco rod when the first cylinder is rolled in the second position;

a nozzle disposed adjacent an opening in the first support plate, the nozzle being configured to receive one end of a pre-formed cigarette tube thereupon; and a clamping device slidably coupled to the first support plate and adapted to clamp the pre-formed cigarette tube to the nozzle from at least two sides when the clamping device is actuated.

15. The cigarette forming device of claim 14, wherein the clamping device comprises a biasing element configured to retain the clamping device in an open position.

16. The cigarette forming device of claim 15, wherein the clamping device further comprises an actuation member.

17. The cigarette forming device of claim 15, wherein the clamping device further comprises a recess in the first support plate adapted to receive the biasing member, and wherein the biasing member comprises at least two deformable prongs.

18. The cigarette forming device of claim 17, wherein actuation of the clamping device urges the deformable prongs against one or more sides of the recess, thereby forcing each deformable prong against a side of the nozzle.

19. The cigarette forming device of claim 14, further comprising a pushing device slidably and rotatably coupled to the first cylinder and configured for movement around and along the first cylinder, wherein the pushing device comprises a pushing element adapted to engage and slidably push one end of a shaped tobacco rod in the cylindrical recess toward the first support plate, and wherein rotation of the pushing device about the first cylinder causes the pushing element to move the first cylinder from the second position to the first position.

20. A cigarette forming device comprising:

a contoured base with first and second support plates extending therefrom; first and second cylinders extending between the support plates and rotatably mounted thereto, the first cylinder further being translatably moveable between a first position in which the first cylinder is spaced from the second cylinder, and a second position in which the first cylinder is substantially adjacent to the second cylinder;

a looped belt trained around the cylinders, wherein the portion of the belt between the cylinders forms an open recess adapted to receive a quantity of loose tobacco when the first cylinder is in the first position, and wherein the portion forms a substantially cylindrical recess in which the tobacco may be shaped into a tobacco rod when the first cylinder is rolled in the second position;

a pushing device slidably and rotatably coupled to the first cylinder and configured for movement around and along the first cylinder, wherein the pushing device comprises a pushing element adapted to engage and slidably push one end of a shaped tobacco rod in the cylindrical recess toward the first support plate, and wherein rotation of the pushing device about the first cylinder causes the pushing element to move the first cylinder from the second position to the first position;

a nozzle disposed adjacent an opening in the first support plate, the nozzle being configured to receive one end of a pre-formed cigarette tube thereupon;

a trough extending between and interconnecting the first and second support plates the trough having a top surface and a bottom surface; and a clamping device adapted to clamp the pre-formed cigarette tube to the nozzle from at least two sides when the clamping device is actuated;

wherein the looped belt is trained around the first and second cylinders and the trough;

wherein the recess is formed by a portion of the belt between the first and second cylinders; and wherein the trough is adapted to prevent the portion of the belt forming the recess from contacting other portions of the belt.

* * * * *